US011434894B2

(12) United States Patent
Trainer et al.

(10) Patent No.: US 11,434,894 B2
(45) Date of Patent: Sep. 6, 2022

(54) PERSONAL AIR SAMPLING PUMP ASSEMBLY WITH DIAPHRAGM DAMPING PORTION

(71) Applicant: IDEAL Industries, Inc., Sycamore, IL (US)

(72) Inventors: Brandon Trainer, Bedford (GB); Steve Tearle, Bedford (GB); Aamir Qureshi, Bedford (GB)

(73) Assignee: IDEAL Industries, Inc., Sycamore, IL (US)

( * ) Notice: Subject to any disclaimer, the term of this patent is extended or adjusted under 35 U.S.C. 154(b) by 49 days.

(21) Appl. No.: 17/009,520

(22) Filed: Sep. 1, 2020

(65) Prior Publication Data

US 2020/0392955 A1 Dec. 17, 2020

Related U.S. Application Data

(63) Continuation of application No. 15/136,377, filed on Apr. 22, 2016, now Pat. No. 10,774,825.
(Continued)

(51) Int. Cl.
*F04B 39/12* (2006.01)
*F04B 39/00* (2006.01)
(Continued)

(52) U.S. Cl.
CPC ..... *F04B 45/047* (2013.01); *F04B 39/005* (2013.01); *F04B 39/0027* (2013.01);
(Continued)

(58) Field of Classification Search
None
See application file for complete search history.

(56) References Cited

U.S. PATENT DOCUMENTS 2,405,466 A 8/1946 Tabb
3,282,224 A 11/1966 Bock et al.
(Continued)

FOREIGN PATENT DOCUMENTS

CN 2262114 Y 9/1997
GB 440693 A 1/1936
(Continued)

OTHER PUBLICATIONS

ISA/US, International Search Report and Written Opinion issued on PCT application No. US16/28928, dated Aug. 8, 2016, 8 pages.
(Continued)

*Primary Examiner* — Peter J Bertheaud
*Assistant Examiner* — Geoffrey S Lee
(74) *Attorney, Agent, or Firm* — Greenberg Traurig, LLP

(57) ABSTRACT

An air sampling pump includes a reciprocating piston for operating a diaphragm assembly. The diaphragm includes a valve head including a fluid inlet and a fluid outlet and a fluid chamber defining a fluid path between the inlet and outlet. A diaphragm sealing engages the valve head and encloses the fluid chamber. The diaphragm includes a piston diaphragm membrane portion coupled to the piston for reciprocating with the piston and reciprocation of the piston causes a change in air pressure within the fluid chamber to cause air to move from the fluid inlet toward the fluid outlet. The diaphragm includes a damper membrane portion, which cooperate to reduce an amplitude of pulsation in the airflow at the fluid inlet and fluid outlet.

20 Claims, 14 Drawing Sheets

Related U.S. Application Data

(60) Provisional application No. 62/153,167, filed on Apr. 27, 2015.

(51) Int. Cl.
*F04B 45/047* (2006.01)
*F04B 53/10* (2006.01)

(52) U.S. Cl.
CPC ..... *F04B 39/0055* (2013.01); *F04B 39/0072* (2013.01); *F04B 39/121* (2013.01); *F04B 39/123* (2013.01); *F04B 39/125* (2013.01); *F04B 53/109* (2013.01)

(56) References Cited

U.S. PATENT DOCUMENTS

| | | | |
|---|---|---|---|
| 3,814,552 | A | 6/1974 | Guggenheim et al. |
| 4,063,824 | A | 12/1977 | Baker et al. |
| 4,091,674 | A | 5/1978 | Amey |
| 4,432,248 | A | 2/1984 | Lalin |
| 4,565,501 | A | 1/1986 | Laurendeau et al. |
| 5,107,713 | A | 4/1992 | Peck et al. |
| 5,205,326 | A | 4/1993 | Paley et al. |
| 5,380,164 | A | 1/1995 | Fry et al. |
| 5,732,741 | A | 3/1998 | Shiery |
| 6,257,847 | B1 | 7/2001 | Silver et al. |
| 6,478,052 | B1 | 11/2002 | Conley et al. |
| 6,808,517 | B2 | 10/2004 | Greter et al. |
| 7,008,400 | B2 | 3/2006 | Silver et al. |
| 8,366,421 | B2 | 2/2013 | Munakata et al. |
| 8,512,010 | B2 | 8/2013 | Stutz et al. |
| 9,243,710 | B2 | 1/2016 | Henriques, Jr. et al. |
| 9,644,622 | B2 | 5/2017 | Stutz et al. |
| 2003/0031572 | A1 | 2/2003 | Tearle |
| 2007/0292276 | A1* | 12/2007 | Stutz ..... F04B 43/00 417/137 |
| 2009/0246035 | A1 | 10/2009 | Patzer |
| 2010/0045096 | A1 | 2/2010 | Schonlau et al. |
| 2012/0006303 | A1 | 1/2012 | Usui et al. |
| 2012/0063925 | A1 | 3/2012 | Parker |
| 2012/0289934 | A1 | 11/2012 | Greter et al. |

FOREIGN PATENT DOCUMENTS

| | | | |
|---|---|---|---|
| KR | 100677924 | B1 | 5/2006 |
| WO | 2012/006464 | A2 | 1/2012 |

OTHER PUBLICATIONS

European Patent Office, supplementary European search report issued on EP patent application No. 16786954.4, dated Apr. 10, 2018, 7 pages.

Indian Patent Office, Examination Report issued on Indian patent application No. 201717036262, dated Jun. 26, 2020, 6 pages.

KIPO, Office Action issued on Korean patent application No. 10-2017-7032109, dated Nov. 22, 2021, 3 pages.

KIPO, Translation of Office Action issued on Korean patent application No. 10-2017-7032109, dated Nov. 22, 2021, 3 pages.

* cited by examiner

PERSONAL AIR SAMPLING PUMP ASSEMBLY WITH DIAPHRAGM DAMPING PORTION

CROSS REFERENCE TO RELATED APPLICATION

This application is a continuation of U.S. patent application Ser. No. 15/136,377, filed Apr. 22, 2016, now U.S. patent Ser. No. 15/136,377, which in turn is a non-provisional application claiming priority from U.S. Provisional Application Ser. No. 62/153,167, filed Apr. 27, 2015, each of which are incorporated herein by reference in their entirety.

FIELD OF THE DISCLOSURE

The present description relates generally to a diaphragm air pump and more particularly to a personal air sampling pump assembly.

BACKGROUND OF RELATED ART

Personal air sampling pumps and controls are generally known. For instance, U.S. Pat. No. 3,814,552 describes a personal air sampling pump including a solenoid driven rubber diaphragm and rubber flapper check valves to control inlet and outlet flow. The diaphragm has a flexible annulus and a rigid central section and is used with independently timed drive pulses for essentially constant flow with varying load.

Similarly, U.S. Pat. No. 4,063,824 describes a constant flow air sampling pump including a variable drive pump that is connected to a filter and that is driven by an electric motor and is controlled by a feedback circuit of an integrator and an amplifier to maintain a constant flow of air through a dosimeter. The dosimeter is worn by an individual and at the termination of a period of time, such as a work day, the filter is removed and the collected contents are analyzed by conventional techniques such as gas chromatography to determine a level of exposure of the individual using the dosimeter.

Still further, U.S. Pat. No. 4,091,674 describes an electronically timed, positive displacement air sampling pump for use with air sample collecting devices in various environmental conditions. The device provides for average flow rate, independently metered total volume, operating time register and an audible "rate fault" alarm.

U.S. Pat. No. 5,107,713, describes a microprocessor controlled air sampling pump that utilizes a PWM controlled DC electric motor for regulating air flow generated by a diaphragm-type air pump. The control system regulates air flow as a function of the RPM of the motor by establishing a table of values which relate motor RPM to air flow rates. The control system maintains RPM at the desired value but includes a control loop which senses deviations in RPM and adjusts the PWM signals to the motor to regulate RPM.

While the identified devices may generally work for their noted purposes, there is an identifiable need for an improved personal air sampler as disclosed herein.

DETAILED DESCRIPTION

Figure 1:
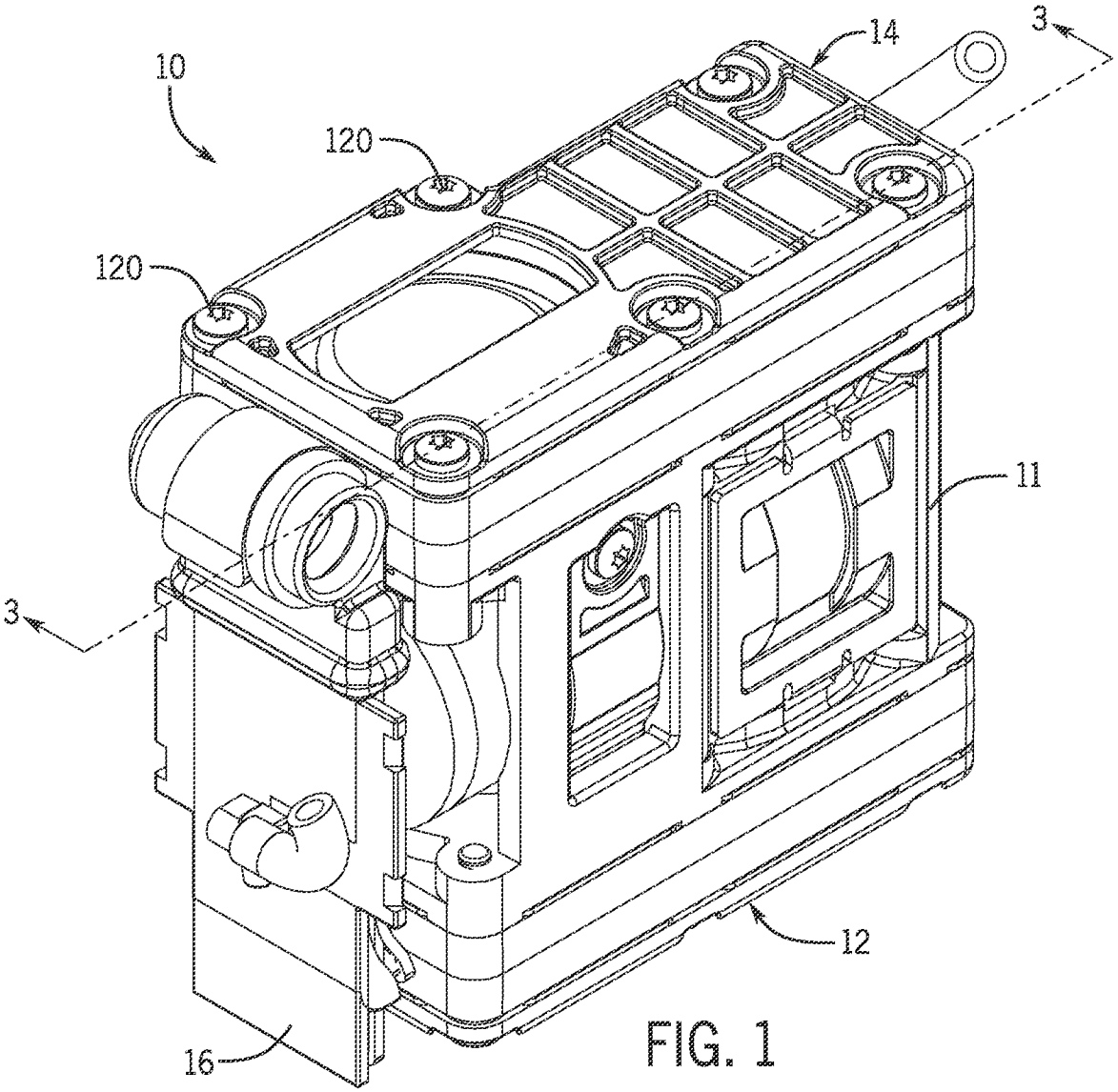
FIG. 1 is a front perspective view of one example of a personal air sampling pump assembly in accordance with the present disclosure.
Figure 2:
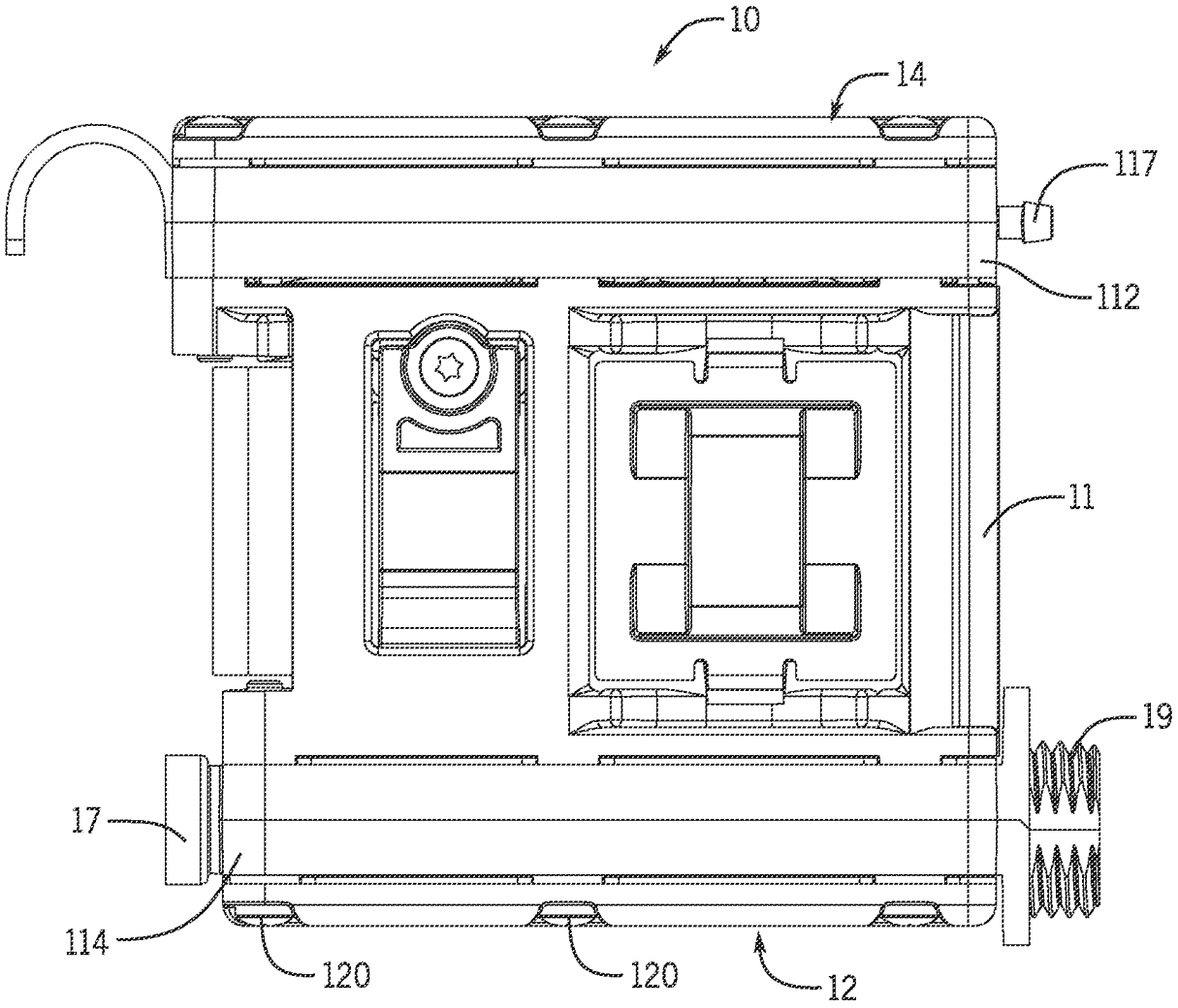
FIG. 2 is a side elevational view of the example personal air sampling pump assembly of FIG. 1.

The following description of example methods and apparatus is not intended to limit the scope of the description to the precise form or forms detailed herein. Instead the following description is intended to be illustrative so that others may follow its teachings.

The present disclosure is generally directed toward a rotary diaphragm air pump that integrates the function of piston head diaphragms, airflow flow pulsation dampers and sealing gaskets within a single compact housing assembly. In general, the layered design arrangement disclosed may reduce manufacturing cost, the number of component parts used to effect operation, and/or the overall product size. The present design may reduce assembly time and may create a 'fail-safe' assembly procedure that typically does not require the use of adhesives or sealants. As a result of the integrated design, a relatively optimal flow performance can be achieved with minimal flow pulsations.

In the personal air sampling pump application where particulate material may be collected onto a filter medium, low pulsation of the inlet airflow is oftentimes desired to prevent vibration of the collection filter and subsequent loss of the deposited material. A smooth airflow is also highly desired to ensure the correct performance of size-selective inlet devices such as cyclones. Furthermore, in at least some examples, the pulsation performance of the presently disclosed personal air sampling pump complies with the requirements of international Air Sampling Pump Standards such as ISO13137.

Referring now to FIGS. 1-10, an example of a personal air sampling pump assembly 10 is illustrated. It will be understood that in the present disclose, the terms fluid, air, gas, etc. may be equivalently utilized, and the operating principles of the present disclosure should not be limited to any specific gas, fluid, or mixture unless specifically stated otherwise. The example pump assembly 10 generally defines a housing comprising a motor housing 11, a first valve head and pulsation damper assembly 12 and a second valve head and pulsation damper assembly 14. In this example, the pump assembly 10 further includes an outlet assembly 16 fluidly coupled to the first valve head and pulsation damper assembly 12 via an outlet 17. The outlet assembly 16 may include a device or other suitable structure that for the purpose of outlet flow rate sensing. It will be understood that the outlet assembly may include and/or may be coupled to any suitable device to provide "further processing" on the outlet fluid including, for example, monitoring for toxins, radiation, etc. In operation, a motor 18 is used to drive an oscillatory linear motion of an articulated pump piston assembly 20 mounted within the motor housing 11. In this example, the articulated pump piston assembly 20 includes a dual piston setup 20*a*, 20*b*, with each of the pistons 20*a*, 20*b* coupled to drive an associated piston diaphragm. In particular, in this example, the oscillating motion of the piston and the piston diaphragm is used to pump air through a valve the valve head and pulsation damper assemblies 12, 14 as best viewed in FIGS. 4, 7A, 7B.

In one example, operation of the motor 18 may be controlled by a closed loop flow control system as disclosed in copending U.S. application Ser. No. 14/688,370, entitled "Air Sampler With Closed Loop Flow Control System," filed Apr. 16, 2015, and incorporated herein by reference in its entirety.

Figure 3:
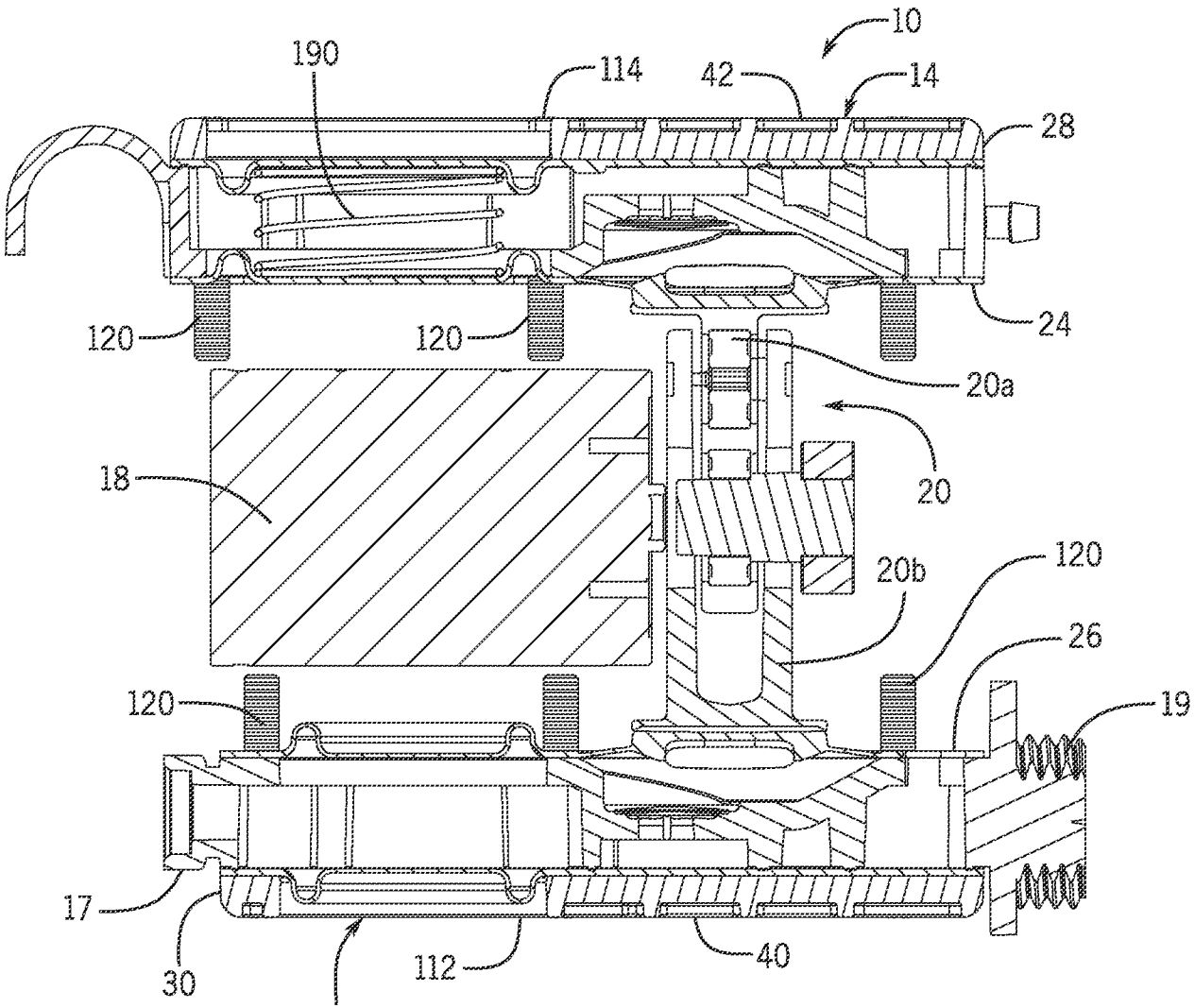
FIG. 3 is a cross sectional view of the example personal air sampling pump assembly of FIG. 1 taken along line 3-3.
Figure 7A:
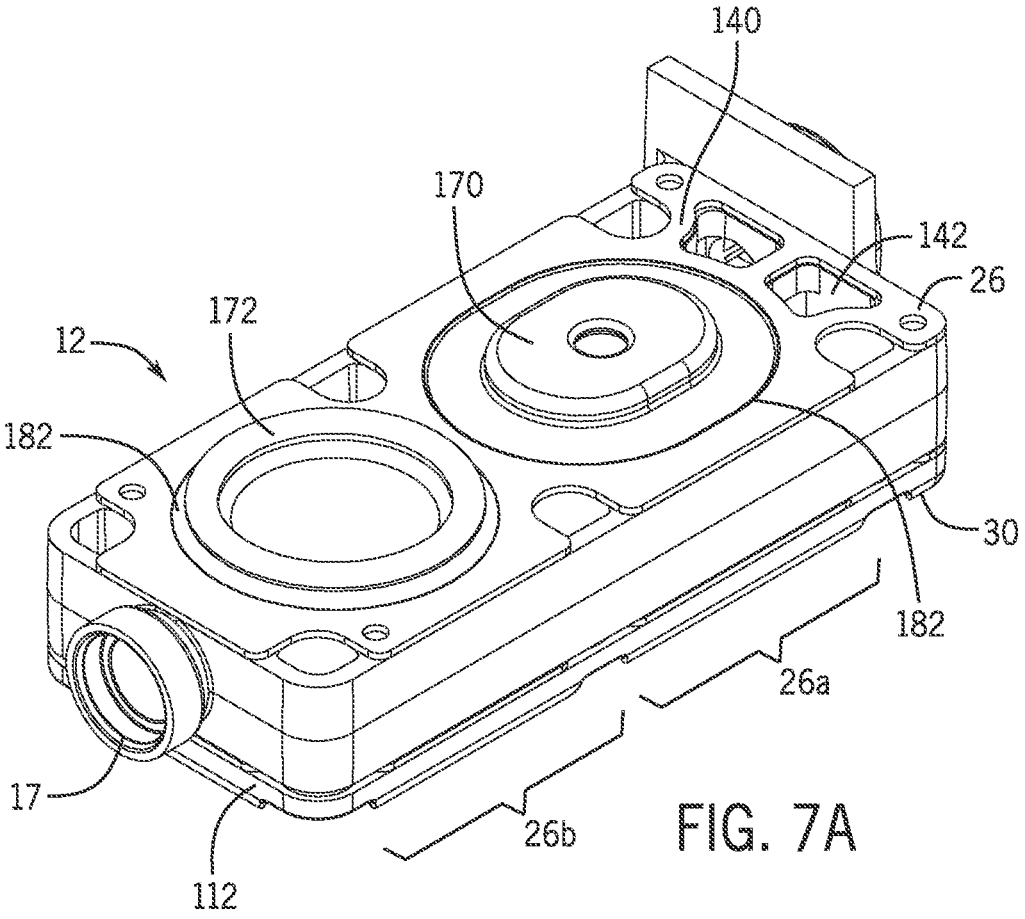
FIG. 7A is a perspective view of a valve chest with an inlet pulsation damper for use with the example personal air sampling pump assembly of FIG. 1.
Figure 7B:
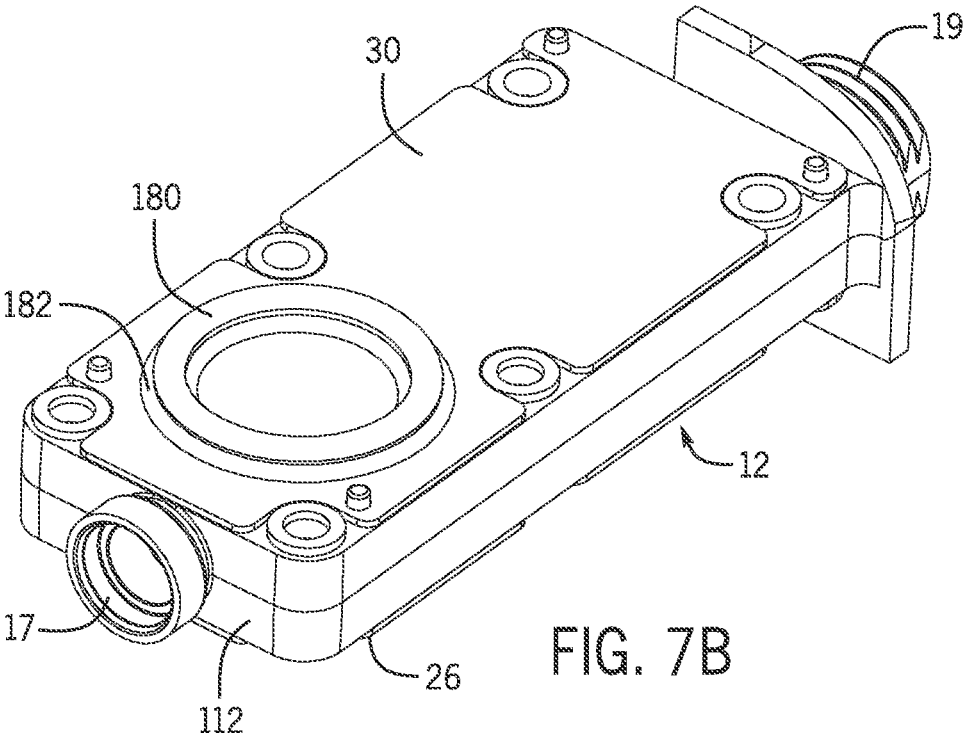
FIG. 7B is a reverse perspective the valve chest with an inlet pulsation damper of FIG. 7A.
Figure 8A:
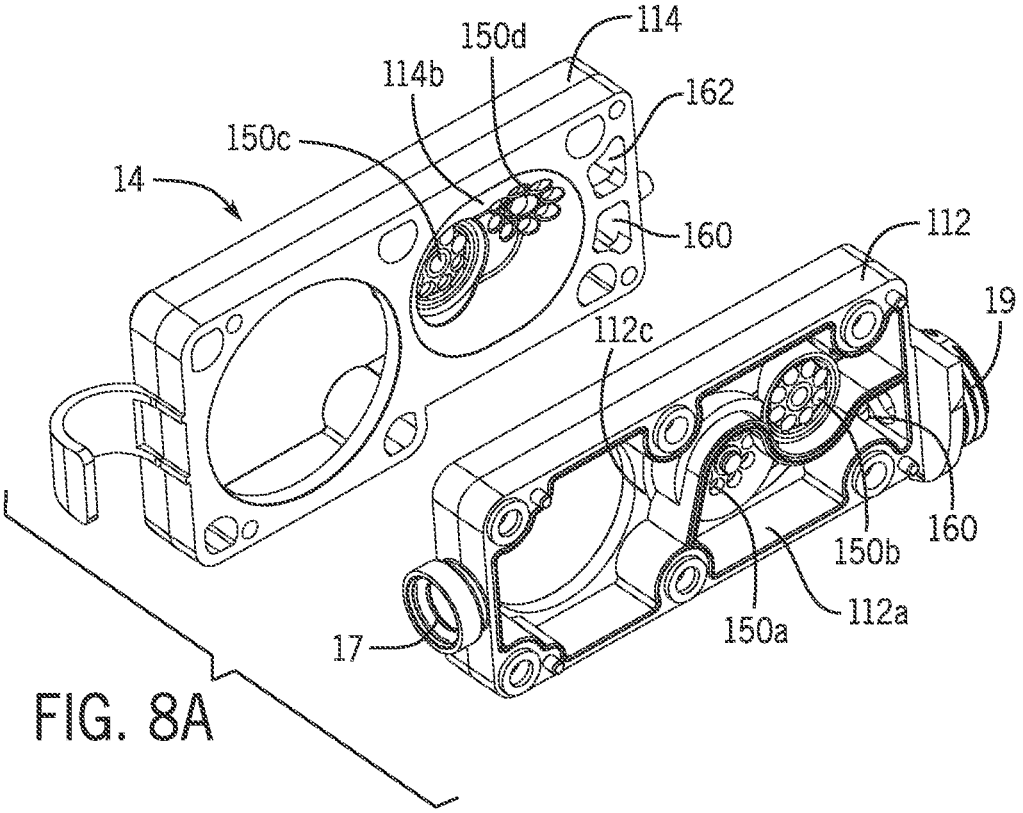
FIG. 8A is a perspective view of a two example valve head and pulsation damper assemblies for use with the example personal air sampling pump assembly of FIG. 1.
Figure 8B:
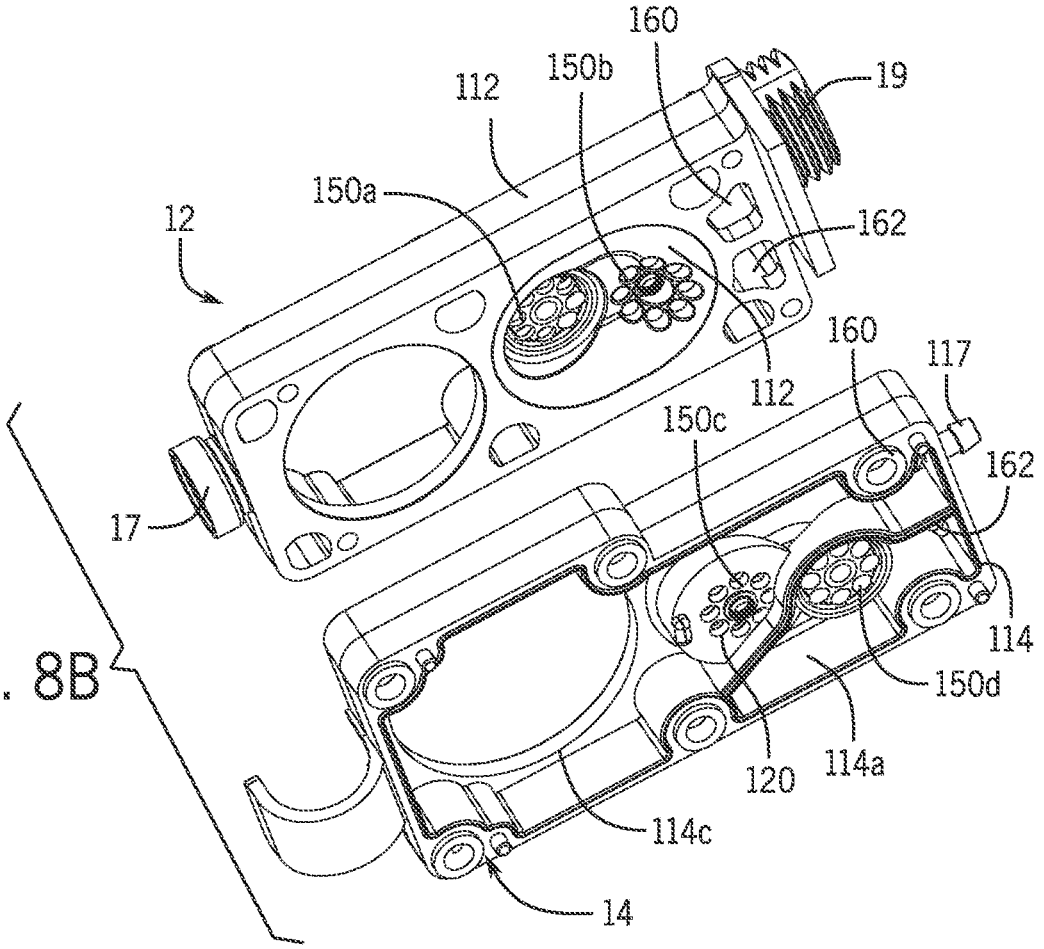
FIG. 8B is a reverse perspective view of the two valve head and pulsation damper assemblies of FIG. 8A.
Figure 9:
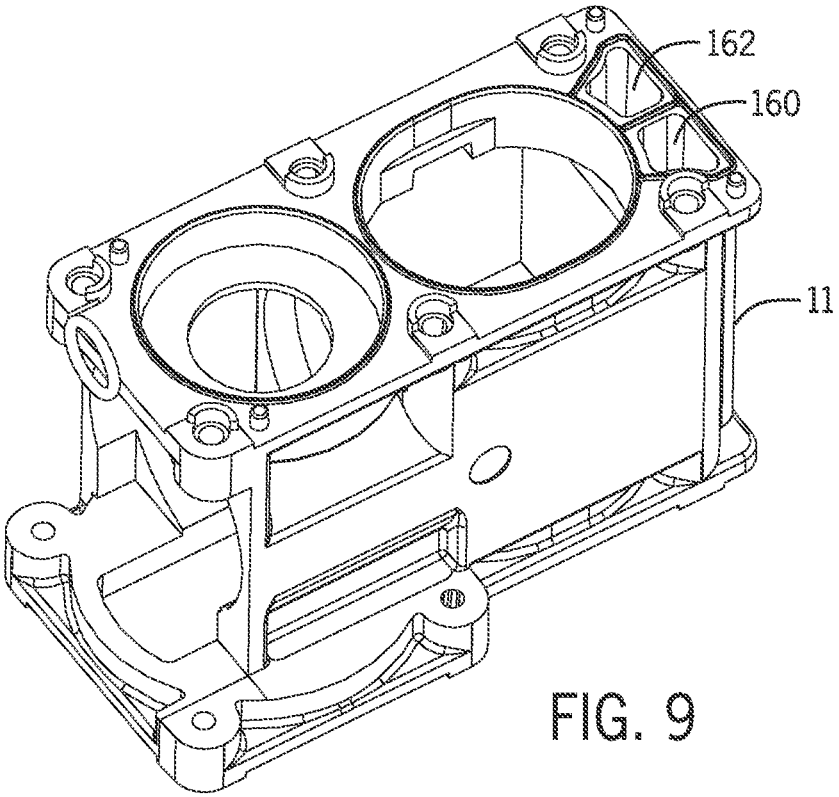
FIG. 9 is a perspective view of an example motor housing for use with the example personal air sampling pump assembly of FIG. 1.
Figure 10:
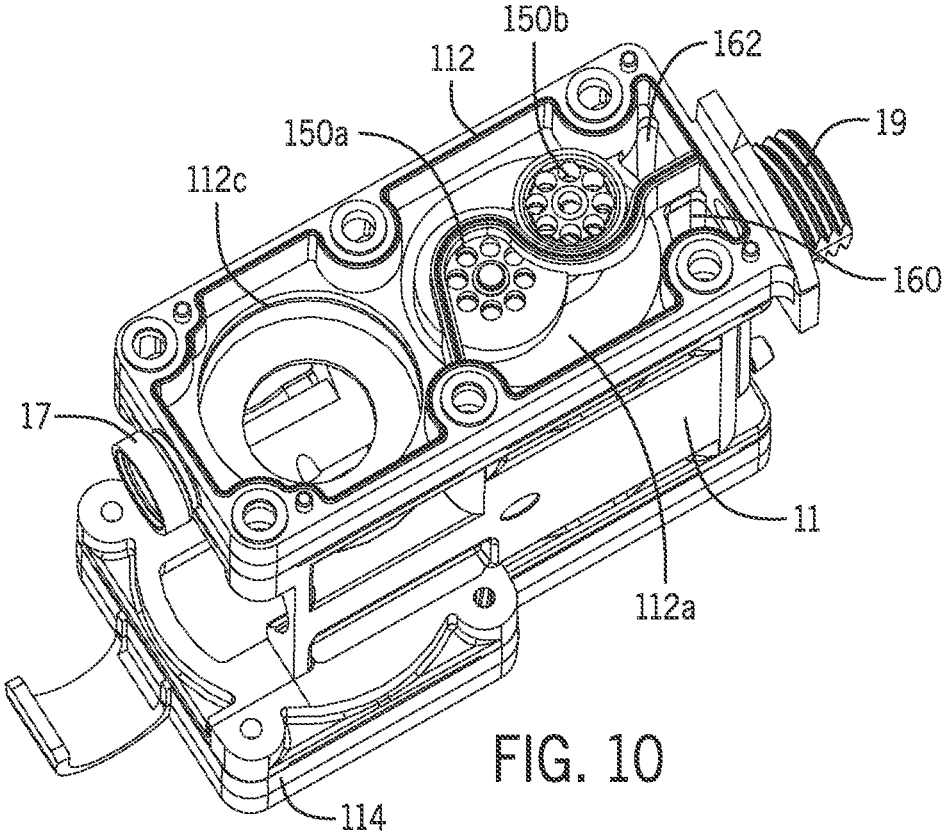
FIG. 10 is a perspective view of the motor housing of FIG. 9 coupled to the valve head and pulsation damper assemblies of FIGS. 8A and 8B.

Referring to FIG. 3, in this example, the valve head and pulsation damper assembly 14 forms a second air chamber, while the valve head and pulsation damper assembly 12 forms a first air chamber. Together, the pistons 20*a*, 20*b*, and the assemblies 12, 14, respectively form a piston diaphragm assembly. Each of the valve head and pulsation damper assemblies 14, 12 generally includes a housing or head, including for instance, a first valve head 112 and a second valve head 112. Each of the first head 112 and second head 114 includes a first elastomeric element 24, 26 that is coupled to one of the pistons 20*a*, 20*b*, and that seals one side of the associated head 112, 114. A second set of elastomeric elements 30, 32 are located on an opposite side of each of the valve heads 112, 114 to seal the second side of the valve head. Each of the valve heads 112, 114, may additionally be sealed via a cover plate 40, 42 securely fastened to the associated head 112, 114 via any suitable method, including via a plurality of fasteners, such as threaded fasteners 120. It will be appreciated that FIGS. 7A and 7B illustrate one example of the valve head and pulsation damper 12. The example assembly 12 includes the valve head 112, with elastomeric elements 26, 30 sealing coupled to either side of the valve head 112. The valve head 112 includes an inlet 19 in addition to the outlet 17. As will be described in detail herein, the valve head 112 and the elastomeric element 26 includes a plurality of apertures 140, 142 to allow fluid communication between the valve heads 112, 114 through a first conduit 160 and a second conduit 162 formed in the motor housing 11.

Referring to FIGS. 8A, 8B, and FIGS. 3 and 4, each of the valve heads 114, 112, defines various air chambers 112*a*, 112*b*, 112*c*, and 114*a*, 114*b*, 114*c*, respectively. In the illustrated example, the various air chambers 112*a*, 112*b*, 112*c*, and 114*a*, 114*b*, 114*c* are fluidly coupled via a plurality of apertures 150. Each of the apertures 150 may include a check valve 152, which are each hidden in FIGS. 8A, 8B, but are visible in FIGS. 3 and 4. As is known in the art, the check valves 152 may be utilized to provide for a single airflow direction and to prevent air from flowing in a non-desired direction.

Accordingly, in this example construction, the inlet 19 is fluidly coupled to the air chamber 112*a* and also to the conduit 160. The air chamber 112*a* is fluidly coupled to the air chamber 112*b* through a first set of apertures 150*a* and one of the check valves 152. The air chamber 112*b* is subsequently fluidly coupled to the air chamber 112*c* though a second set of apertures 150*b* and another one of the check valves 152. The conduit 162 is similarly fluidly coupled to the air chamber 112*c*. Finally, the air chamber 112*c* is fluidly coupled to the outlet 17.

Referring to the valve head 114, the air chamber 114*c* is fluidly coupled to the conduit 160 to receive air from the valve head 112. An outlet 117 is provided in the valve head 114 and in this instance may be coupled to a pressure sensor (not shown) to monitor the pressure of the device 10. It will be appreciated that the outlet 117 may be coupled to any device, conduit, sensor, or other suitable device as desired. The air chamber 114*c* is coupled to the air chamber 114*b* through a third set of apertures 150*c* including another one of the check valves 152. Next, the air chamber 114*b* is coupled to the air chamber 114*a* and the conduit 162 through a fourth set of apertures 10*d* including a further one of the check valves 152. As noted above, the conduit 162 is fluidly coupled to the air chamber 112*c* through the motor housing 11.

Figure 4:
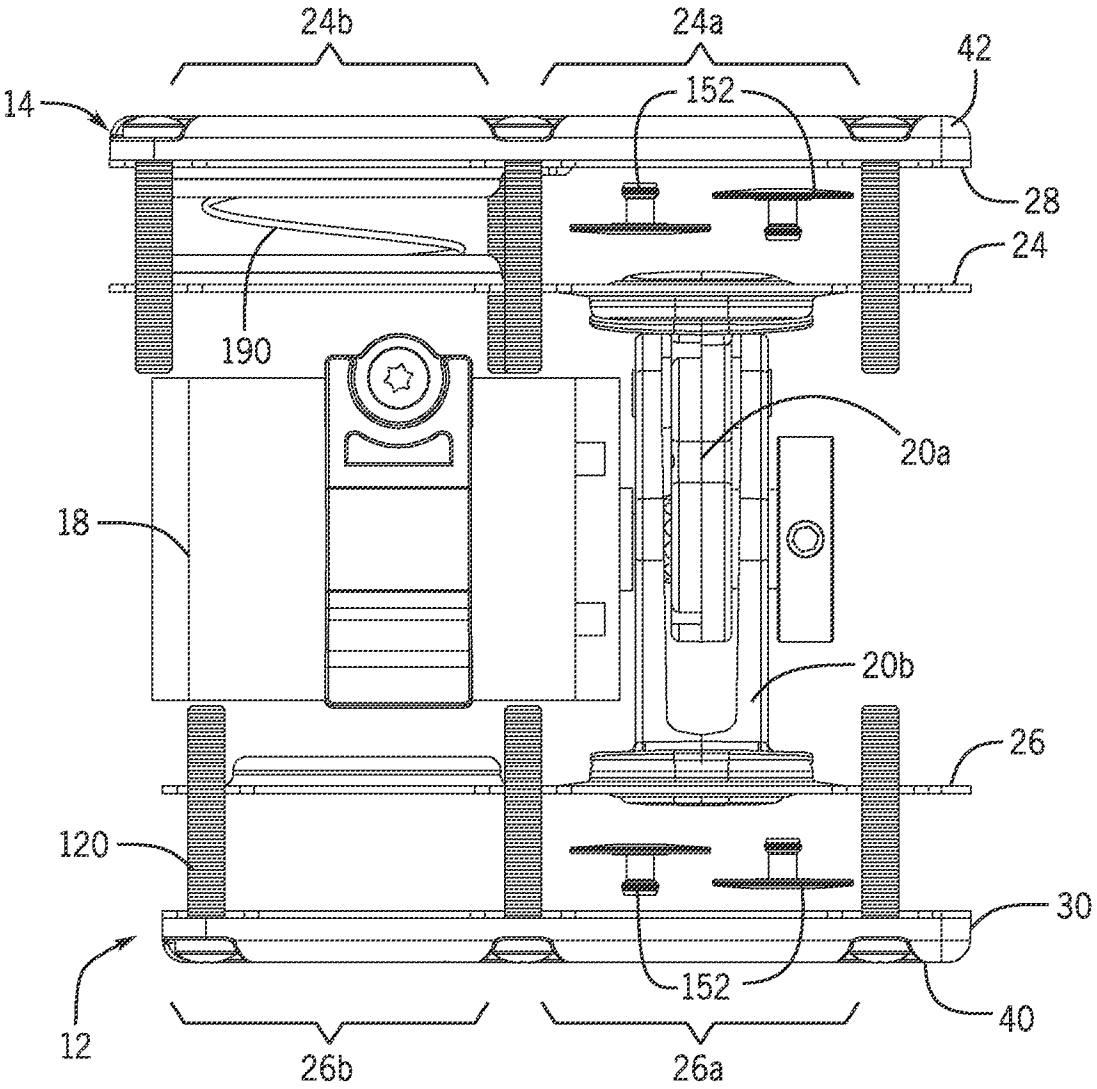
FIG. 4 is a side elevational view of the example personal air sampling pump assembly of FIG. 1 with a portion of the housing removed.
Figure 5:
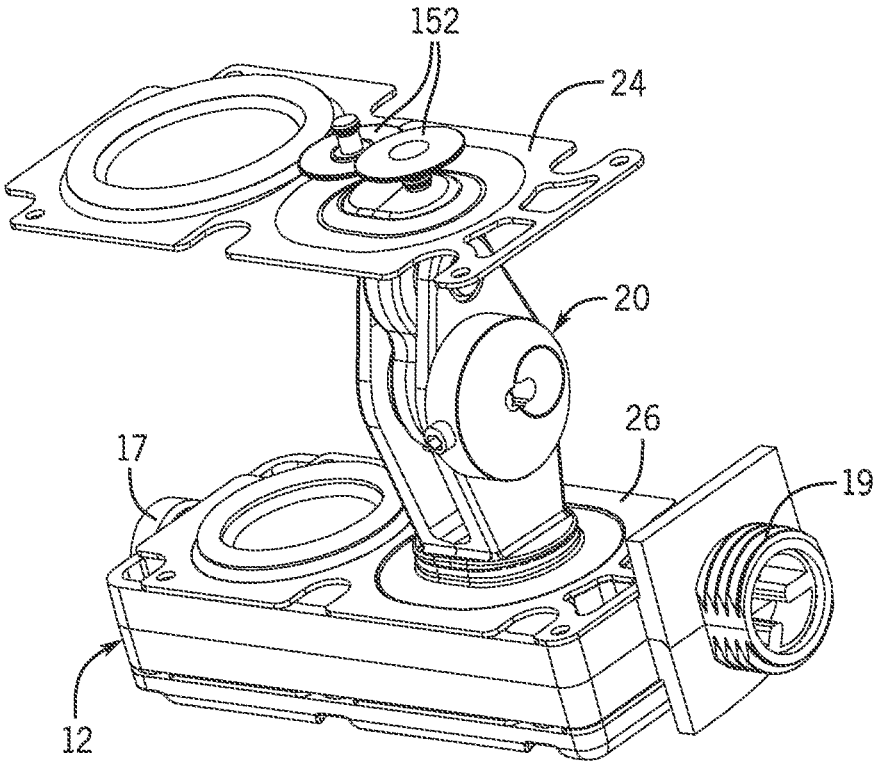
FIG. 5 is a perspective view of the example personal air sampling pump assembly of FIG. 1 with additional components removed to show additional details of the motor and piston assembly.
Figure 6:
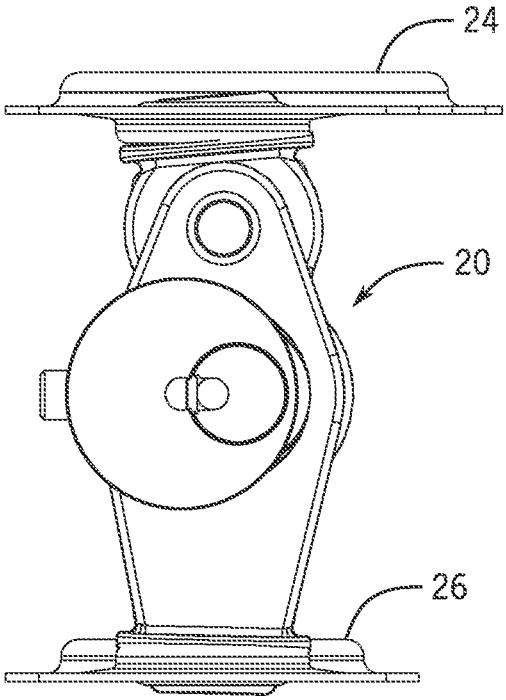
FIG. 6 is a side elevational view of the example personal air sampling pump assembly of FIG. 1 showing the motor and pistons coupled to the first elastomeric diaphragms.

As will be appreciated, each of the elastomeric membranes 24, 26, 28, 30 serves to perform multiple functions and, in this example as illustrated in FIG. 4, generally includes a piston diaphragm portion 24*a*, 26*a*, and a pulsation damper membrane portion 24*b*, 26*b*, respectively. In particular, for each assembly 14, 12, the layered construction includes multiple elastomeric diaphragms separated by a valve head as described above. Each of the first elastomeric elements is generally considered an elastomeric piston diaphragm molding. As shown in FIG. 7A, the example elastomeric element 26 provides a sealing gasket between the motor housing 11 (removed in FIG. 7A) and the valve head 112, and includes a pump diaphragm membrane 170 which is coupled to one of the pistons 20, and a flexible damper membrane 172. Meanwhile, as illustrated in FIG. 7B, the example elastomeric element 30 similarly provides a sealing gasket between the cover plate 40 (removed in FIG. 7B) and the valve head 112, and includes a flexible damper membrane 180.

Although not illustrated in FIGS. 7A and 7B, the construction of the valve head and pulsation damper assembly 14 may be similar to the construction described in relation to the illustrated valve head and pulsation damper assembly 12, or may be any suitable design. Furthermore, the layered construction of the present disclosure may be applicable to a single acting (i.e., a single piston diaphragm assembly) or a double action pump design as disclosed herein.

As illustrated, the elastomeric elements 26, 30 may include a plurality of raised line features such as the raised line future 182, on the surface of the respective elements 11, 112, 114, 40, and 42 to locally increase the compressive force applied to the membrane and to aid in sealing the entire assembly.

The pulsation damper membrane portions 24*b*, 26*b* are generally formed from the combination of the flexible elastomeric damper membranes 26, 30 and the enclosed air chamber 112*c* formed within the valve head 112. The combination of the elastic structure and the associated cavity volume reduces the amplitude of pulsations in the pump's inlet and outlet airflow. In addition, as shown in FIG. 4, the damper membrane portions 24*b*, 26*b*, may optionally include a spring 190, such as a coil spring, or other suitable mechanism to alter the spring characteristics of the membranes 26, 30 and the damper response. Further, the flow pulsation dampener portion 24*b*, 26*b* generally reduces the level of pulsations induced by the actions of the diaphragm. In a typical personal sampling pump, the magnitude of pulsations in the air flow velocity leads to changes in the performance characteristics of size selective sampling heads such as cyclones.

As will be appreciated by one of ordinary skill in the art, the action of the reciprocating piston 20 against the piston diaphragm portion 24*a*, 26*a* may be used to create a positive or negative air pressure pumping effect as desired. The piston diaphragm portion 24*a*, 26*a* are used to move a volume of gas or air, and the elastomeric membranes 24, 26, 28, 30 are stretched across the valve heads 112, 114 and not physically bonded thereto. In operation, the motor 20 including eccentric connecting rods create oscillatory pumping motion in the elastomeric membranes 24, 26.

Figure 11:
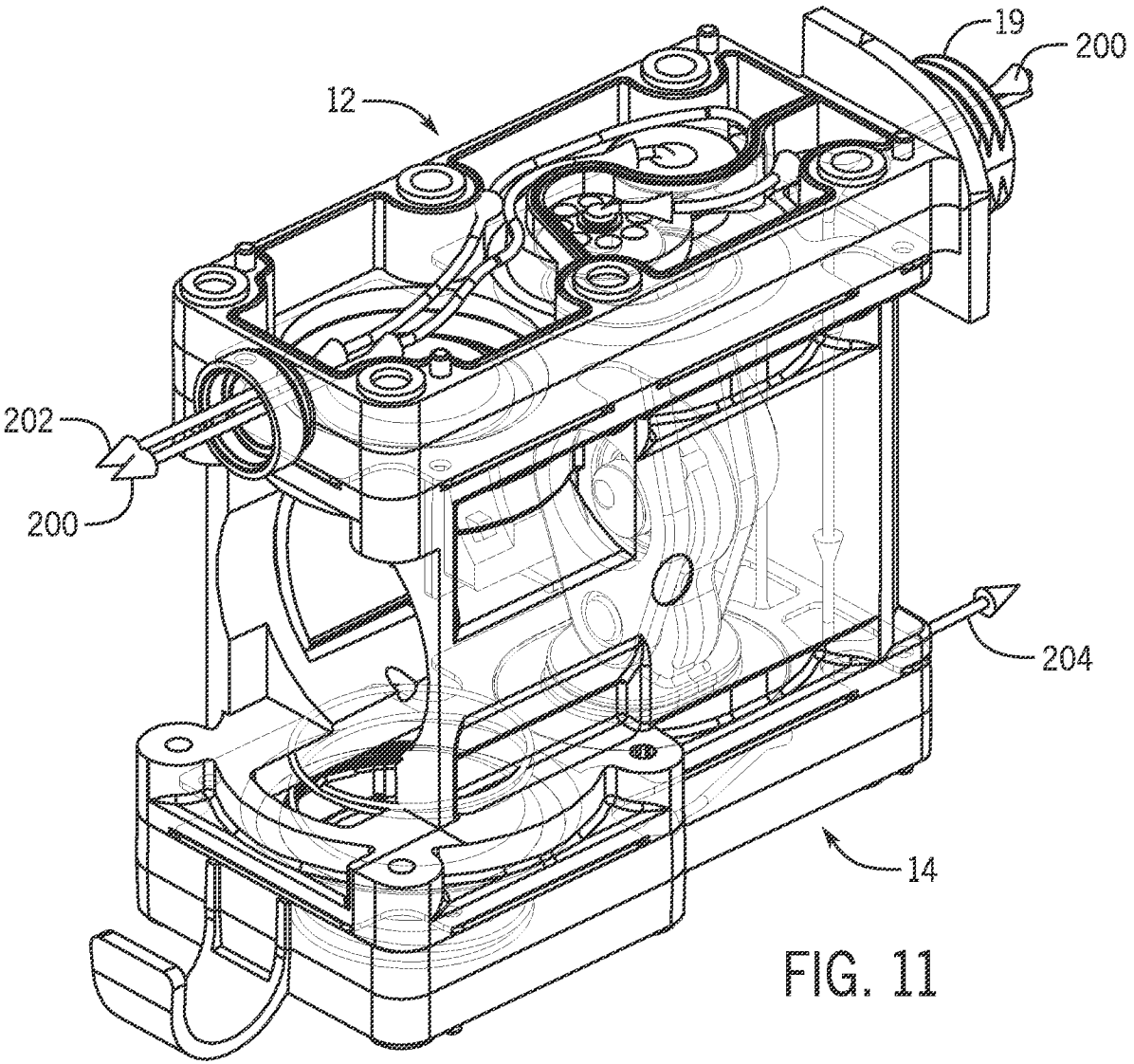
FIG. 11 is a transparent perspective view of the example personal air sampling pump assembly of FIG. 1 showing an example fluid flow path.
Figure 12:
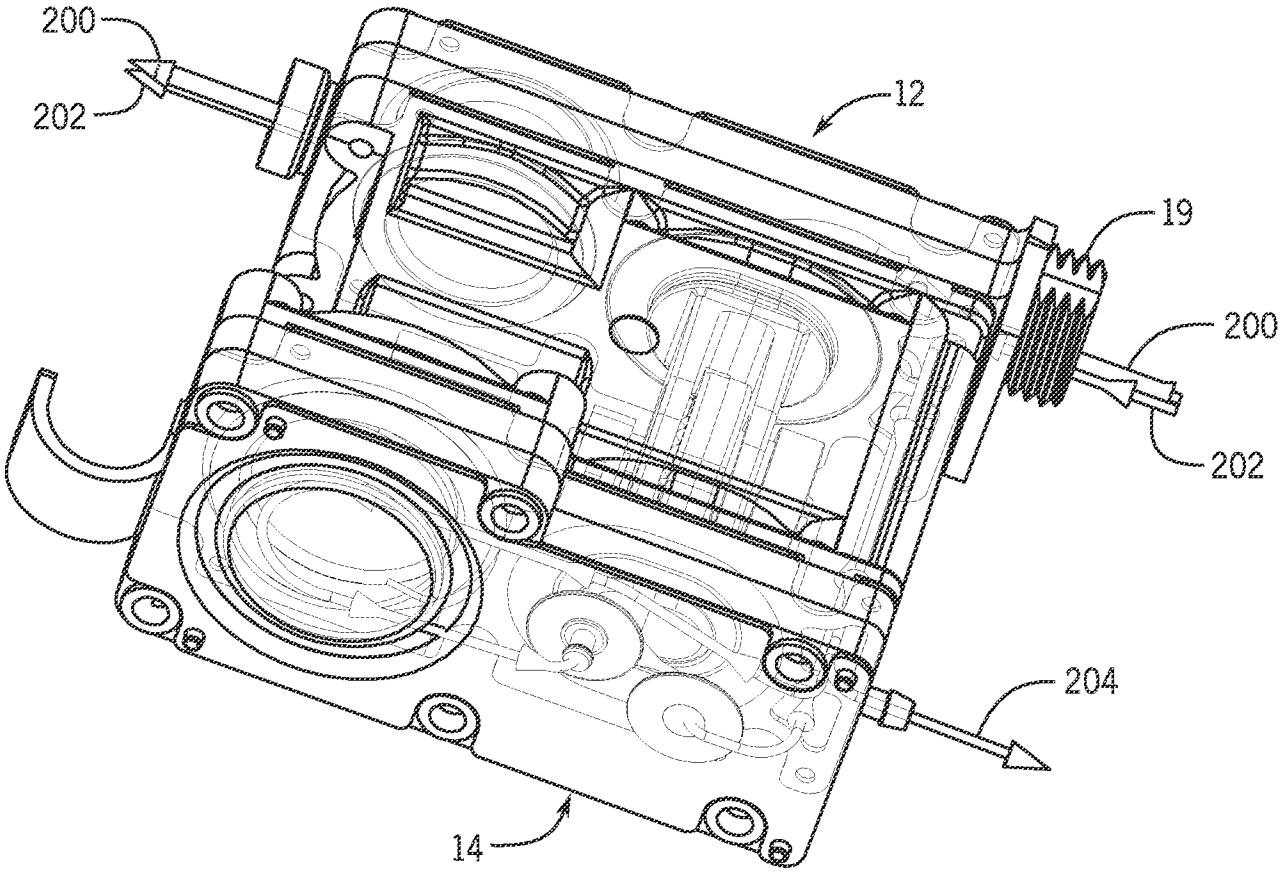
FIG. 12 is an alternative perspective view of FIG. 11 additionally showing the example fluid flow path.

The movement caused by the piston diaphragm assemblies is used to move a volume of fluid, gas, or air as illustrated in FIGS. 11 and 12. In general, air enters into the assembly 10 at the inlet 19 and flows one of two fluid paths 200, 202 as shown. In the first path 200, the air enters the inlet 19 and travels through the three air chambers 112*a*, 112*b*, 112*c*, under influence of air pressure caused by the operation of the piston diaphragms portions 24*a*, 26*a*, and exits the assembly 10 at the outlet 17, where it may travel through the outlet assembly 16 for flow sensing and/or other suitable processing, or through any other suitable device. At the same time, at least a portion of the air entering at the inlet 19 may travel via the second air path 202 into the conduit 160 and into the air chambers 114*a*, 114*b*, 114*c*. As noted above, a portion of the air 204 may be bled through the outlet 117 for any suitable purpose, including for instance, for pressure sensing. The air may then return to the valve head 112 and specifically the air chamber 112*c* through the conduit 162, where the air may similarly exit through the outlet 17.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. An air sampling pump comprising: a housing; a piston reciprocally driven along a first line within the housing; a diaphragm assembly extending in a second line traverse to the first line and operably coupled to the piston, the diaphragm assembly comprising: a valve head including a fluid inlet and a fluid outlet and defining a fluid chamber fluidly coupling the fluid inlet and the fluid outlet and forming a fluid path from the fluid inlet to the fluid outlet; a diaphragm sealingly engaging the valve head, the diaphragm comprising a piston diaphragm membrane portion coupled to the piston for reciprocating with the piston and enclosing a first portion of the fluid chamber, and a damper membrane portion spaced from the piston diaphragm membrane portion along the second line and enclosing a second portion of the fluid chamber; and a check valve disposed within the fluid path, wherein reciprocation of the piston causes a change in air pressure within the fluid chamber to cause aft to move from the fluid inlet toward the fluid outlet, the change in air pressure causes a corresponding movement of the damper membrane portion and movement of the damper membrane portion decreases vibration of the air sampling pump as the air is caused to move from the fluid inlet to the fluid outlet in response to each reciprocation of the piston.

2. The air sampling pump as recited in claim 1, further comprising a motor mounted to the piston for reciprocally driving the piston.

3. The air sampling pump as recited in claim 2, wherein the motor is supported by the housing.

4. The air sampling pump as recited in claim 1, wherein the diaphragm assembly is mounted to the housing.

5. The air sampling pump as recited in claim 1, wherein the fluid inlet and the fluid outlet are integrally formed within the housing.

6. The air sampling pump as recited in claim 1, wherein the valve head includes a pressure sensor.

7. The air sampling pump as recited in claim 1, wherein the fluid chamber comprises:

a first fluid sub-chamber fluidly coupled to the fluid inlet;

a second fluid sub-chamber fluidly coupled to the first fluid sub-chamber via a first aperture; and a third fluid sub-chamber fluidly coupled to the second fluid sub-chamber via a second aperture and fluidly coupled to the fluid outlet.

8. The air sampling pump as recited in claim 7, wherein the check valve is sealingly mated to the first aperture to substantially prevent fluid from traversing from the second fluid sub-chamber to the first fluid sub-chamber.

9. The air sampling pump as recited in claim 8, further comprising a second check valve sealingly mated to the second aperture to substantially prevent fluid from traversing from the third fluid sub-chamber to the second fluid sub-chamber.

10. The air sampling pump as recited in claim 8, wherein the piston diaphragm membrane portion is operably coupled to the second fluid sub-chamber.

11. The air sampling pump as recited in claim 8, wherein the damper membrane portion is operably coupled to the third fluid sub-chamber.

12. The air sampling pump as recited in claim 11, wherein the damper membrane portion encloses, at all times, the third fluid sub-chamber.

13. The air sampling pump as recited in claim 1, wherein the fluid outlet is a first fluid outlet, and wherein the air sampling pump further comprises a second fluid outlet configured to bleed air out of the fluid chamber.

14. The air sampling pump as recited in claim 13, wherein the second fluid outlet is coupled to a pressure sensor configured to monitor the pressure within the fluid chamber.

15. The air sampling pump as recited in claim 1, wherein the air sampling pump is configured to draw air, and not liquid, into the fluid chamber via the fluid inlet.

16. The air sampling pump as recited in claim 15, wherein the air drawn into the fluid chamber is environmental air.

17. The air sampling pump as recited in claim 15, wherein the air sampling pump is configured to draw air through a filter medium such that particulate material in the air may be collected on the filter medium.

18. An air sampling pump comprising: a housing; a piston reciprocally driven along a first line within the housing; a diaphragm assembly extending in a second line traverse to the first line and operably coupled to the piston, the diaphragm assembly comprising: a valve head including a fluid inlet and a fluid outlet and defining a fluid chamber fluidly coupling the fluid inlet and the fluid outlet and forming a fluid path from the fluid inlet to the fluid outlet; a diaphragm sealingly engaging the valve head, the diaphragm comprising a piston diaphragm membrane portion coupled to the piston for reciprocating with the piston and enclosing a first portion of the fluid chamber, and a damper membrane portion spaced from the piston diaphragm membrane portion along the second line and enclosing, at all times, a second portion of the fluid chamber; and a check valve disposed within the fluid path, wherein reciprocation of the piston causes a change in air pressure within the fluid chamber to cause air to move from the fluid inlet toward the fluid outlet, and the change in air pressure causes a corresponding movement of the damper membrane portion, wherein movement of the damper membrane portion decreases vibration of the air sampling pump.

19. The air sampling pump of claim 18, wherein air does not pass through the damper membrane portion.

20. An air sampling pump comprising: a housing; a piston reciprocally driven within the housing; a diaphragm assembly operably coupled to the piston, the diaphragm assembly comprising: a valve head including a fluid inlet and a fluid outlet and defining a fluid chamber fluidly coupling the fluid inlet and the fluid outlet and forming a fluid path from the fluid inlet to the fluid outlet; a diaphragm sealingly engaging the valve head, the diaphragm comprising a piston diaphragm membrane portion coupled to the piston for reciprocating with the piston and enclosing a first portion of the fluid chamber, and a damper membrane portion spaced from the piston diaphragm membrane portion and enclosing a second portion of the fluid chamber; and a check valve disposed within the fluid path, wherein reciprocation of the piston causes a change in aft pressure within the fluid chamber to cause aft to move from the fluid net toward the fluid outlet, and the change in air pressure causes a corresponding movement of the damper membrane portion, wherein movement of the damper membrane portion decreases vibration of the air sampling pump.

* * * * *